US006337542B1

(12) United States Patent
Hanaki et al.

(10) Patent No.: US 6,337,542 B1
(45) Date of Patent: Jan. 8, 2002

(54) ORGANIC ELECTROLUMINESCENT DISPLAY DEVICE HAVING LUMINANCE DEGRADATION COMPENSATING FUNCTION

(75) Inventors: Takashi Hanaki; Koji Ogusu, both of Kariya; Naoki Matsumoto, Aichi-gun, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/633,143

(22) Filed: Aug. 4, 2000

(30) Foreign Application Priority Data

Sep. 17, 1999 (JP) ..... 11-264156

(51) Int. Cl.[7] ..... G06G 3/10

(52) U.S. Cl. ..... 315/169.3; 345/45; 345/76; 345/77; 345/214; 345/215

(58) Field of Search ..... 315/169.3, 169.1, 315/169.2, 163; 345/214, 215, 44, 45, 48, 55, 76, 77

(56) References Cited

U.S. PATENT DOCUMENTS 5,923,309 A * 7/1999 Ishizuka et al. ..... 345/77
5,982,345 A * 11/1999 Takayama et al. ..... 345/82
5,990,629 A * 11/1999 Yamada et al. ..... 315/169.3
6,008,588 A * 12/1999 Fujii ..... 315/169.1
6,215,462 B1 * 4/2001 Yamada et al. ..... 345/76

FOREIGN PATENT DOCUMENTS

JP 6-13181 1/1994

* cited by examiner

*Primary Examiner*—Don Wong
*Assistant Examiner*—Thuy Vinh Tran
(74) *Attorney, Agent, or Firm*—Law Office of David G. Posz

(57) ABSTRACT

In an electroluminescent (EL) display device having a plurality of organic EL elements, variations in luminance among the EL elements are equalized. EL elements to be driven for a required image display are periodically applied with drive voltages and a recovery voltage, while the other EL elements are periodically applied with a dummy voltage. The period, the repetition period, and the amplitude of the dummy voltage are set not to illuminate the other EL elements, while promoting degradation of the other EL elements to some extent. Alternatively, the drive voltage applied to drive the EL elements for the required image display may be modified in accordance with the degree of degradation thereof.

15 Claims, 9 Drawing Sheets

ORGANIC ELECTROLUMINESCENT DISPLAY DEVICE HAVING LUMINANCE DEGRADATION COMPENSATING FUNCTION

CROSS REFERENCE TO RELATED APPLICATION

This application relates to and incorporates herein by reference Japanese Patent Application No. 11-264156 filed on Sept. 17, 1999.

BACKGROUND OF THE INVENTION

The present invention relates to an organic electroluminescent (EL) display device having an organic EL display panel in which a plurality of organic EL elements are provided.

Organic EL display devices are widely used recently, particularly in the field of a compact-sized display. The organic EL device is advantageous in that it requires no back-light, has a quick response characteristics, provides a wide viewing angle, and the like. It also provides a higher luminance and requires a lower drive voltage than an inorganic EL display device.

Organic EL elements of the organic EL device degrade with time much faster than inorganic EL elements. The EL elements are driven differently from one another with respect to the number of elements being driven at a particular time. The luminance of each EL element will decrease as it is driven more frequently. Thus, the organic EL display device will have some EL elements that are degraded more than others as the use of the organic EL display device proceeds. Thus, the organic EL display device will resultantly have variations in luminance.

SUMMARY OF THE INVENTION

It is therefore an object of the present invention to provide an organic EL display device that has less variations in the luminance of display.

According to the present invention, an EL display device has a plurality of organic EL elements and a drive circuit which applies a drive voltage to EL elements to be driven for a required image display. The drive circuit is so constructed to equalize a degree of degradation in luminance among the EL elements.

In one aspect of the present invention, the circuit periodically applies a dummy voltage to the EL element that is not driven for the required image display operation, while applying the drive voltage to the EL elements that are driven. The dummy voltage promotes degradation of the non-driven EL elements. Preferably, the dummy voltage has a wave form different from that of the drive voltage and a period shorter than that of the drive voltage.

In another aspect of the present invention, the circuit modifies the drive voltage applied to the EL elements to be driven. For instance, the circuit may apply an operation characteristics recovery voltage following the drive voltage to the EL element to be driven that is more degraded than the other. The circuit may apply an initial drive voltage to the EL element to be driven that is less degraded than the other, only when a power supply is started for starting the required image display operation. Preferably, the degree of degradation of each EL element is determined base on an accumulated drive period, the number of drives or the like.

In a further aspect of the present invention, the circuit applies the drive voltage for a screen saver operation to all the EL elements or only EL elements that are less degraded.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
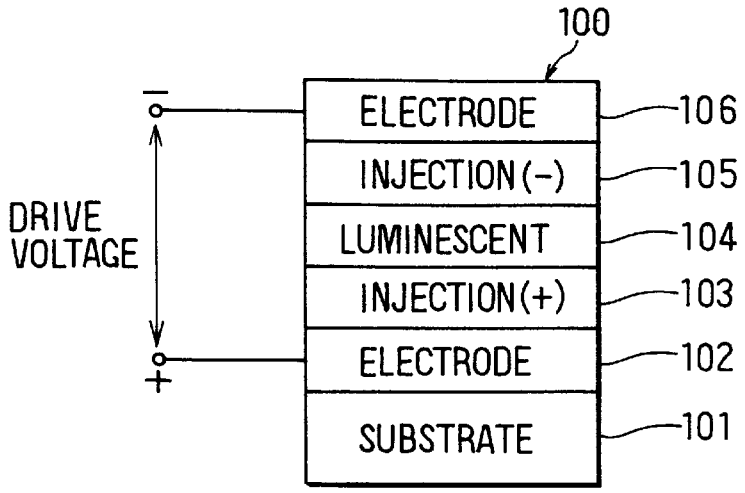
FIG. 1 is a sectional view of an organic EL elements used in an organic EL display device according to a first embodiment of the present invention.

The present invention will be described in more detail with reference to various embodiments in which the same or like parts are designated with the same or like reference numerals.

(First Embodiment)

Referring first to FIG. 1, an organic EL element 100 comprises a stack of a glass substrate 101, a transparent positive-side electrode 102, a plurality of organic layers (hole injection layer 103, luminescent layer 104 and electron injection layer 105) and a negative-side electrode 106. The EL element 100 emits light due to recombination of the holes injected from the positive side into the luminescent layer 104 and the electrons injected from the negative side into the luminescent layer 104, when a drive voltage of a fixed polarity is applied between the electrodes 102 and 106. The hole injection layer 103 and the electron injection layer 105 may be provided as the case may be. The negative-side electrode 106 may be a transparent-type if it is desired to pass the emitted light through the negative side as well.

Figure 2:
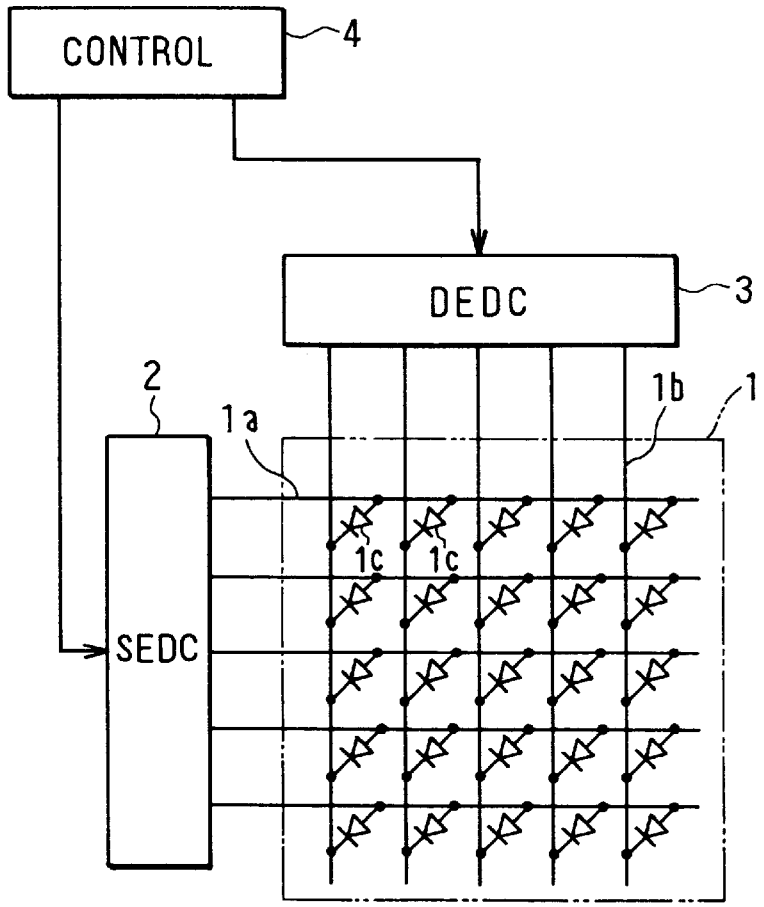
FIG. 2 is an electrical circuit diagram of the organic EL display device according to the first embodiment.

The EL element 100 is arranged in a matrix shape to form an organic EL display panel 1 as shown in FIG. 2. Since the EL element 100 is a current-driven type, it is shown as a diode and designated with a reference numeral 1*c* in FIG. 2. Specifically, each EL element 100 is formed at a plurality of points where a plurality of scanning electrodes 1*a* aligned in a row direction and a plurality of data electrodes 1*b* aligned in a column direction cross each other.

The display panel 1 is connected to a scanning electrode driver circuit (SEDC) 2 and a data electrode driver circuit (DEDC) 3 to be driven by drive voltages for emitting light. The drive voltage is a composite of a scan voltage supplied by the driver circuit 2 and a data voltage supplied by the driver circuit 3. The driver circuits 2 and 3 are connected to a control circuit 4. The control circuit 4 controls voltage generating operations of the driver circuits 2 and 3 in correspondence with display data supplied from an EL controller (not shown).

Figure 3A:
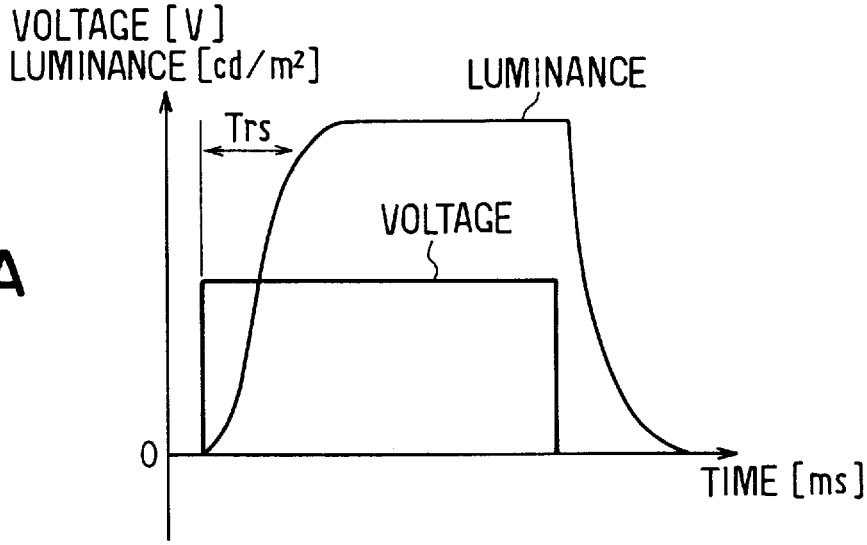
FIGS. 3A to 3C are signal diagrams of drive voltages applied to the EL element shown in FIG. 1, respectively.

The control circuit 4 is constructed so that it periodically applies the drive voltage through the driver circuits 2 and 3 to each EL element 1*c* which is to be driven to illuminate or emit light. As shown in FIG. 3A, the luminance of the EL element 1*b* changes with a certain response delay Trs relative to a pulse-shaped driving voltage.

Figure 3B:
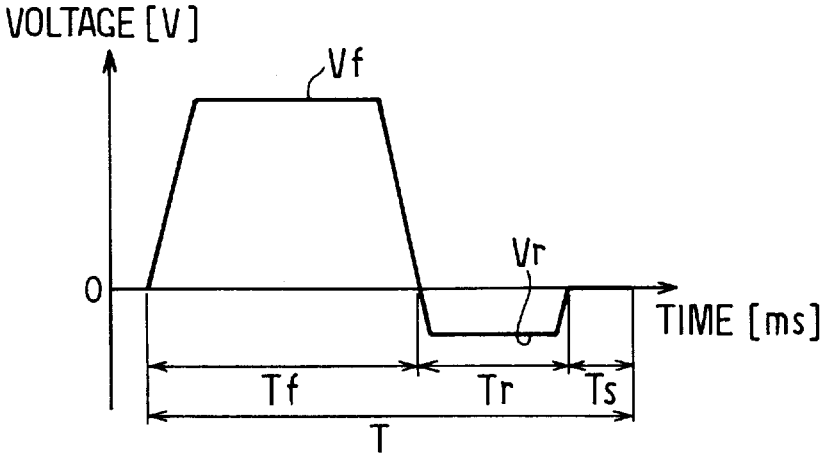

Specifically, each drive voltage may be a generally pulse-shaped positive voltage Vf having a time period Tf as shown in FIG. 3B. Further, in this embodiment, a negative voltage Vr having a time period Tr is applied following the positive drive voltage Vf so that the EL element 1*a* recovers its illumination characteristics. The drive voltage Vf may be applied at every predetermined time period T. That is, the drive voltage Vf may be applied after a certain time period Ts following the recovery voltage Tr. Alternatively, the drive voltage Vf may be applied immediately after the recovery voltage Vr without time period Ts. In this embodiment, amplitude values of both the drive voltage Vf and the recovery voltage Vr are set to 9.5 volts, and the repetition period T is set to 16 ms.

Figure 3C:
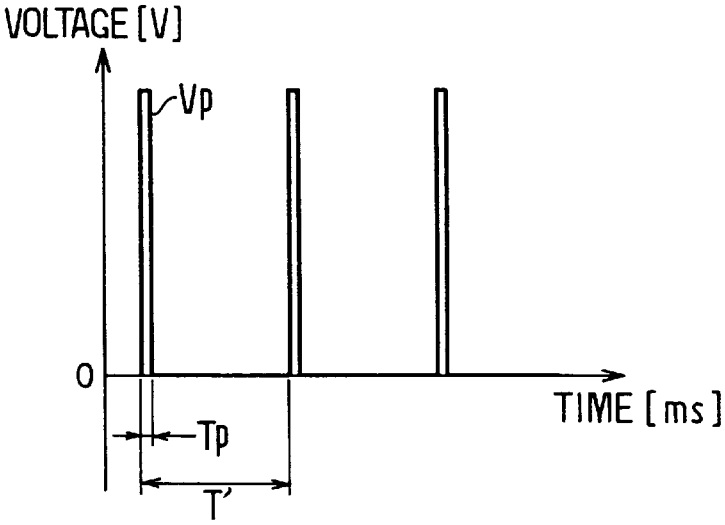

In addition, the control circuit 4 is constructed to apply through the driver circuits 2 and 3 a series of dummy voltages Vp to the EL element 1*c* which is not driven to illuminate, as shown in FIG. 3C, while other organic EL elements are driven as above, that is, while the EL display panel 1 is in operation. The time period Tp of the dummy voltage Vp is set to 1 $\mu$s, for instance, which is far shorter than the response delay Trs shown in FIG. 3A. The amplitude value is set to 11 V, for instance. The repetition period T' of the dummy voltage Vp is set to 10 $\mu$s, for instance, so that the EL element 1*c* is not affected by the application of the dummy voltages Vp.

The dummy voltages periodically applied to inoperative EL elements as above will promote degradation of the inoperative EL elements without affecting display image on the EL. display panel 1. Thus, not only the EL elements 1*c* that are driven by the drive voltages Vf degrade, but also the EL elements 1*c* that are not driven by the drive voltage Vf but driven by the dummy voltages Vp degrade to some extent. As a result, variation in the progress of degradation of the EL elements 1*c* is minimized, and variation in the luminance among the EL elements 1*c* is more equalized. That is, the EL display panel 1 is enabled to provide display images in uniform luminance over its entire display area over a long period of time.

Figure 4A:
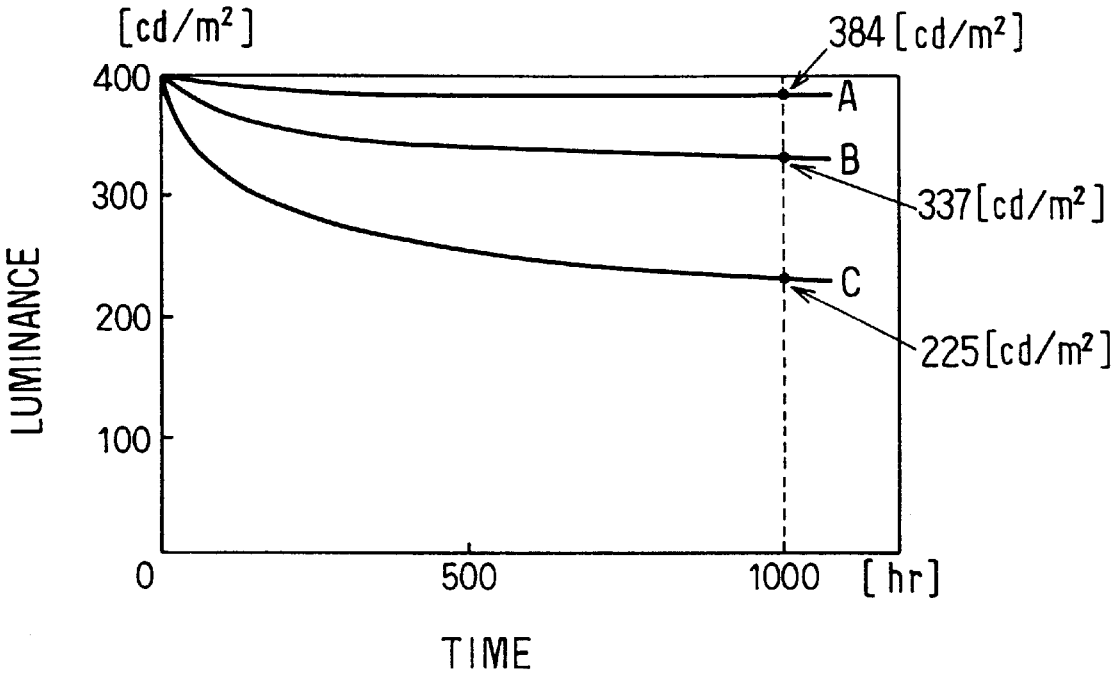
FIGS. 4A and 4B are a graph of time-luminance characteristics of the EL elements and a schematic representation of a display image with different degradation in luminance.
Figure 4B:
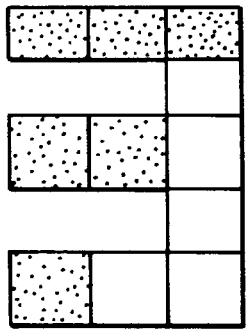

Experimental results of luminance degradation characteristics of various organic EL elements with respect to time are shown in FIGS. 4A and 4B. The characteristics curve A indicates the luminance degradation in the case where no voltage is applied to the EL element 1*c*. The characteristics curve B indicates the luminance degradation in the case where the dummy voltage Vp is applied according to this embodiment. In this instance, the dummy voltage Vp has the period 1 $\mu$s, and is applied at the repetition period of 10 $\mu$s. The characteristics curve C indicates the luminance degradation in the case where the drive voltage Vf is applied to the EL element 1*c*. In this instance, the drive voltage Vf and the recovery voltage Vr have voltage amplitudes of 9.5 V and −9.5 V, respectively. The repetition period T is 16 ms, and the periods Tf and Tr of the voltages Vf and Vr are both 4 ms. The above experiments are conducted at a temperature of 85° C. In FIG. 4A, the luminance indicates values which are provided when an electric current of a fixed current density (0.04 mA/mm$^2$) is supplied to the EL element 1*c* under room temperature. The variations in the luminance is exemplarily shown in FIG. 4B, in which the EL elements 1*c* are shown with different degradation (dotted) in luminance.

It is understood from the experimental results that, after 1000 hours, the luminance of the EL element 1*c* to which no voltage is applied decreases to about 384 cd/m$^2$ as shown by the characteristics curve A, but the luminance of the same to which the drive voltage Vf (FIG. 3B) is applied decreases to about 225 cd/m$^2$ as shown by the characteristics curve C. That is, the luminance of the EL element 1*c* decreases to about 59% (225/384) when the EL element 1*c* is driven with the drive voltage Vf.

It is also understood that, after 1000 hours, the luminance of the EL element 1*c* to which the dummy voltage Vp is applied decreases to about 337 cd/m$^2$ as shown by the characteristics curve B. That is, the luminance of the EL element 1*c* decreases to about 88% (337/384) when the EL element 1*c* is supplied with the dummy voltage. Thus, the dummy voltage Vp improves the ratio of luminance to about 67% (225/337). It takes about 500 hours for the ratio of the luminance of the EL element 1*c* to which the drive voltage Vf (FIG. 3B) is applied (characteristics curve C) relative to the luminance of the same to which no voltage is applied (characteristics curve A) decreases to 67%.

Viewers will normally notice variations in the luminance of the EL display panel 1, when the ratio of luminance between the highest luminance part and the lowest luminance part on the EL display panel 1 reaches about 0.7. Therefore, the EL display panel 1 according to the first embodiment will not exhibit noticeable variations in the luminance until it is operated up to about 1000 hours.

(Second Embodiment)

Figure 5:
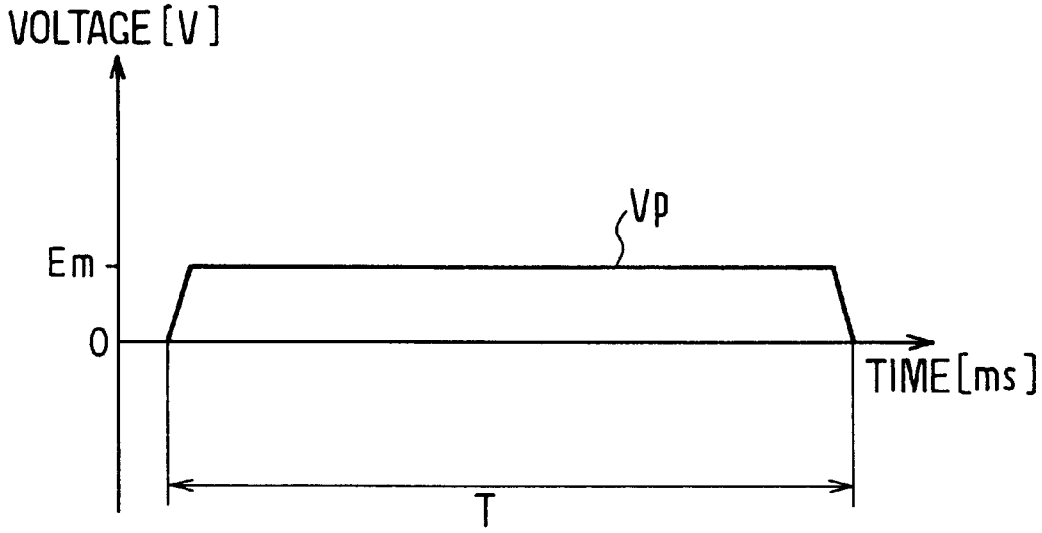
FIG. 5 is a signal diagram of a dummy drive voltage applied to the EL element in a second embodiment of the present invention.
Figure 6:
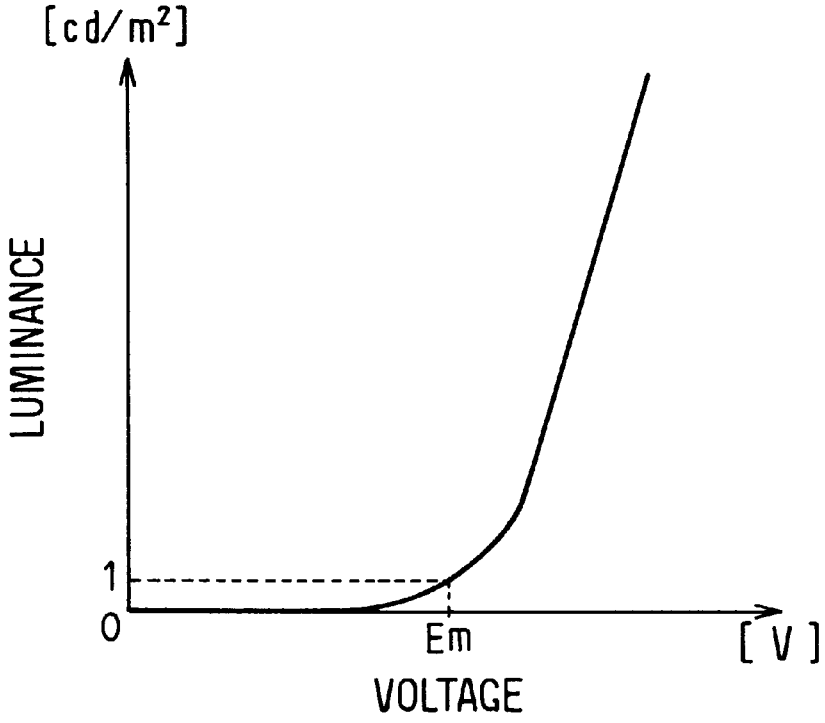
FIG. 6 is a graph of time-luminance characteristics of the EL element in the second embodiment.

In a second embodiment, the control circuit 4 is constructed to supply a dummy voltage Vp of a fixed amplitude shown in FIG. 5 to each EL element 1*a* which is held inoperative, that is, which is not driven by the drive voltage Vf. The fixed amplitude of the dummy voltage Vp is set so that the EL element 1*c* only slightly illuminates with the luminance of about 1 cd/m$^2$, for instance, or less. As shown in FIG. 6, the luminance of the EL element 1*c* increases as the applied voltage increases. Therefore, the dummy voltage is limited to less than Em with which the EL element 1*c* illuminates with luminance of 1 cd/m$^2$. The EL element 1*c* may be supplied with a fixed dummy current in place of the fixed dummy voltage Vp.

According to the second embodiment, the dummy voltage Vp of low amplitude also promotes degradation of the EL element 1*c* to some extent even when it is held inoperative.

Thus, this embodiment is also effective to prolong the period after which the EL display panel 1 comes to exhibit noticeable variations in the luminance of the displayed images.

(Third Embodiment)

Figure 7:
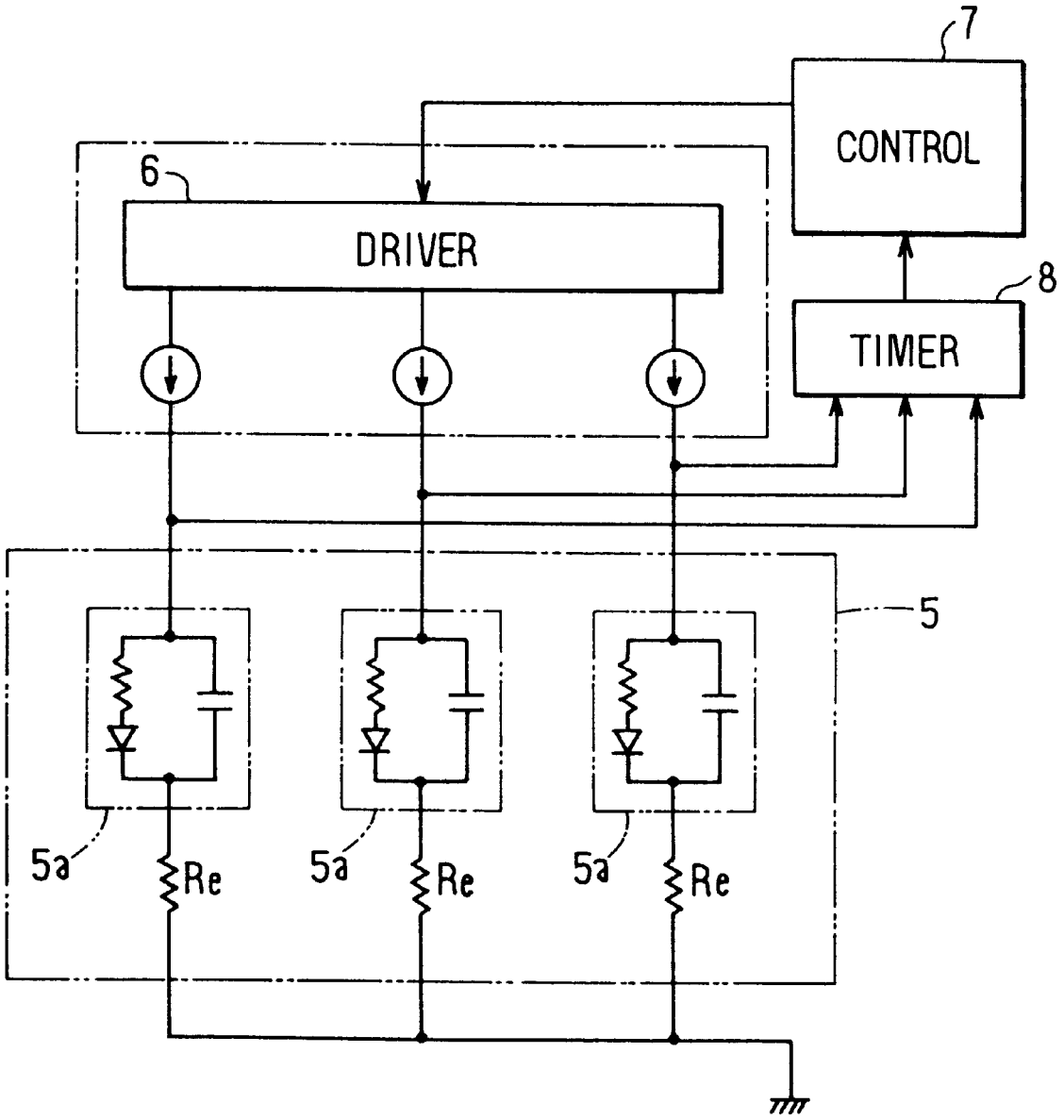
FIG. 7 is an electrical circuit diagram of the organic EL display device according to a third embodiment of the present invention.

In a third embodiment, each EL element 100 shown in FIG. 1 is shaped in a segment and arranged to form an EL display panel 5 as shown in FIG. 7. The EL element 5*a* is shown in an electrically equivalent circuit form as a combination of a capacitor, resistor and diode. An electrical wire for the EL element 5*a* is shown to have a resistor 5*e*. The EL element 5*a* is connected to a constant current driver circuit 6 to be driven with a constant current when driven by the drive voltage of the driver circuit.

A control circuit 7 is constructed to selectively apply the drive voltages to the EL elements 5*a* through the current driver circuit 6 in response to the display data supplied from an EL controller (not shown). A timer 8 is provided to measure and accumulate the period of illumination of each EL element 5*a* individually so that the resultant accumulated period is supplied to the control circuit 7. The control circuit 7 is constructed to determine the degree of degradation in luminance of each EL element 5*a* based on the accumulated period of illumination.

Figure 8:
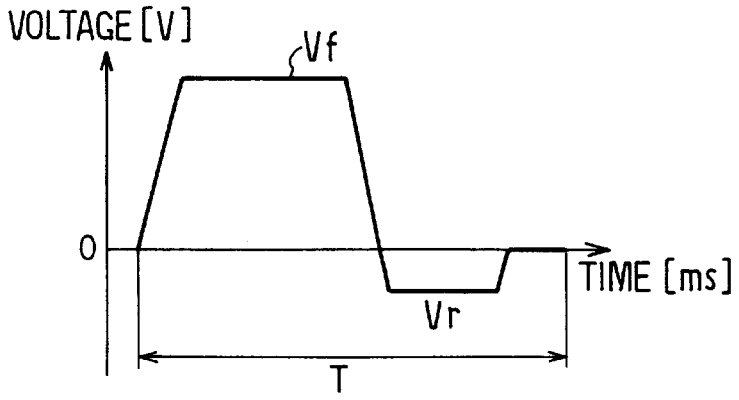
FIG. 8 is a signal diagram of the drive voltage applied to the EL element in the third embodiment.
Figure 9:
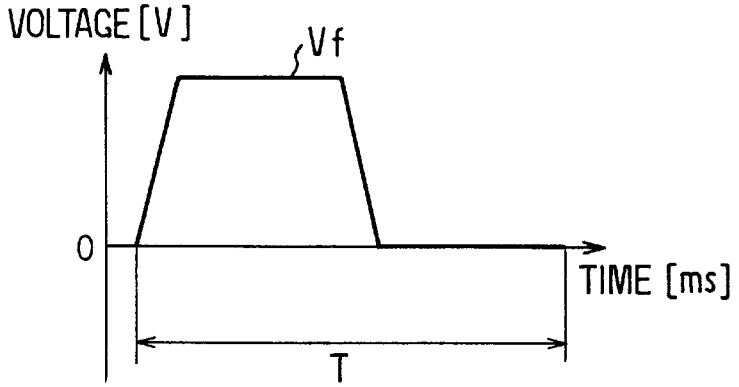
FIG. 9 is a signal diagram of the drive voltage applied to the EL element in the third embodiment.

Specifically, the control circuit 7 periodically applies drive voltages Vf and a recovery voltage Vr shown in FIG. 8 through the current driver circuit 6 in the same manner as in the first embodiment, when the accumulated period is more than a predetermined reference, that is, when the EL element 5*a* to be driven is determined to be more degraded. On the other hand, the control circuit 7 periodically applies only the drive voltage Vf shown in FIG. 9 through the current driver circuit 6, when the accumulated period is less than the predetermined reference, that is, when the EL element 5*a* to be driven is determined to be less degraded.

Figure 10:
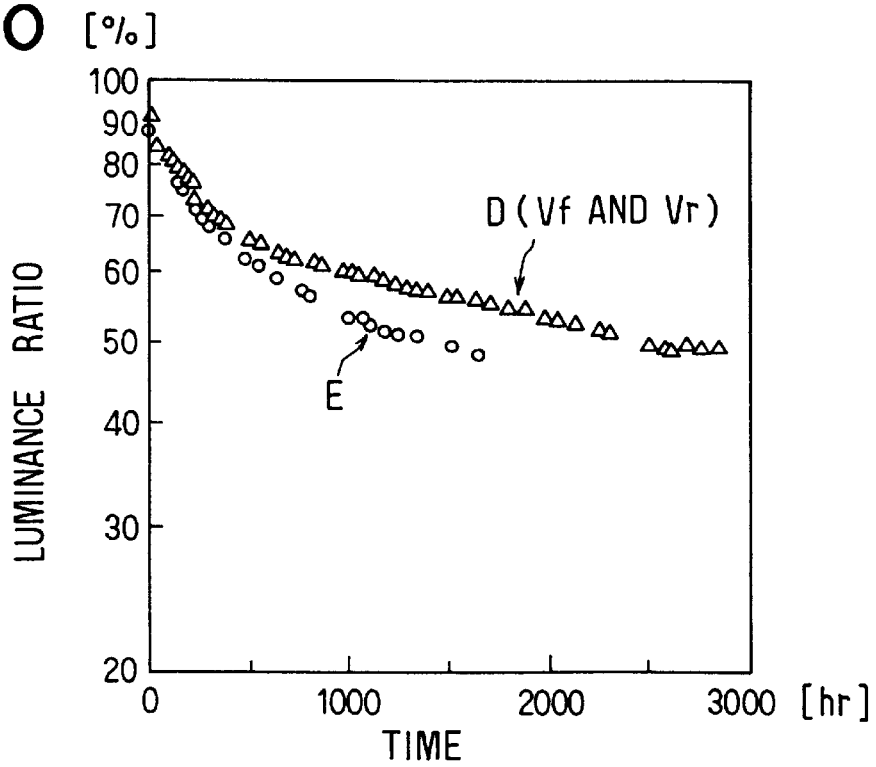
FIG. 10 is a graph of time-luminance characteristics of the EL element in the third embodiment.

FIG. 10 shows the experimental results of the second embodiment. The data D indicates the measured deterioration characteristics in the luminance of the EL element 5*a* in the case where both the drive voltage Vf and the recovery voltage Vr (FIG. 8) are applied alternately in the periodic manner. The data E indicates the measured deterioration characteristics in the luminance of the EL element 5*a* in the case where only the drive voltage Vf (FIG. 9) is applied in the periodic manner.

It is understood from FIG. 10 that the degradation in luminance of the EL element 5*a* to which both the voltages Vf and Vr are applied (data D) proceeds more slowly than that of the EL element 5*a* to which only the drive voltage Vf is applied (data E). That is, the recovery voltage Vf is effective to slow down the degradation in luminance. Thus, the degradation in luminance of the more-deteriorated organic EL element 5*a* can be suppressed by applying the recovery voltage Vr in addition to the drive voltage Vf. As a result, the length of time in which the organic EL display panel 5 maintains uniform luminance of the display information can be prolonged.

Further, because the recovery voltage Vr is opposite in polarity to the drive voltage Vf, a greater operation characteristics recovery can be provided. This is particularly effective to slow down the degradation of the EL element 5*a* which is determined to be degrading at a higher speed, and equalize the degree of degradation in luminance among the EL elements 5*a*.

In the third embodiment, the timer 8 may be replaced with a counter which counts the number of driving each EL element 5*a*, because each period of illumination of the EL element 5*a* is fixed. Further, in applying the recovery voltage Vr in correspondence with the determination result of the degradation in luminance, the period of application or the amplitude of the recovery voltage Vr may be increased based on the degree of degradation. In this instance, variations in the luminance among the EL elements 5*a* are more equalized.

Still further, the EL display panel 5 constructed in the segment-type may be constructed as the matrix-type EL panel 1 as shown in FIG. 2. In this instance, the period or the number of illumination of each EL element 1*c* should be measured from both of the voltages applied to the electrodes 1*a* and l*b*.

(Fourth Embodiment)

Figure 11:
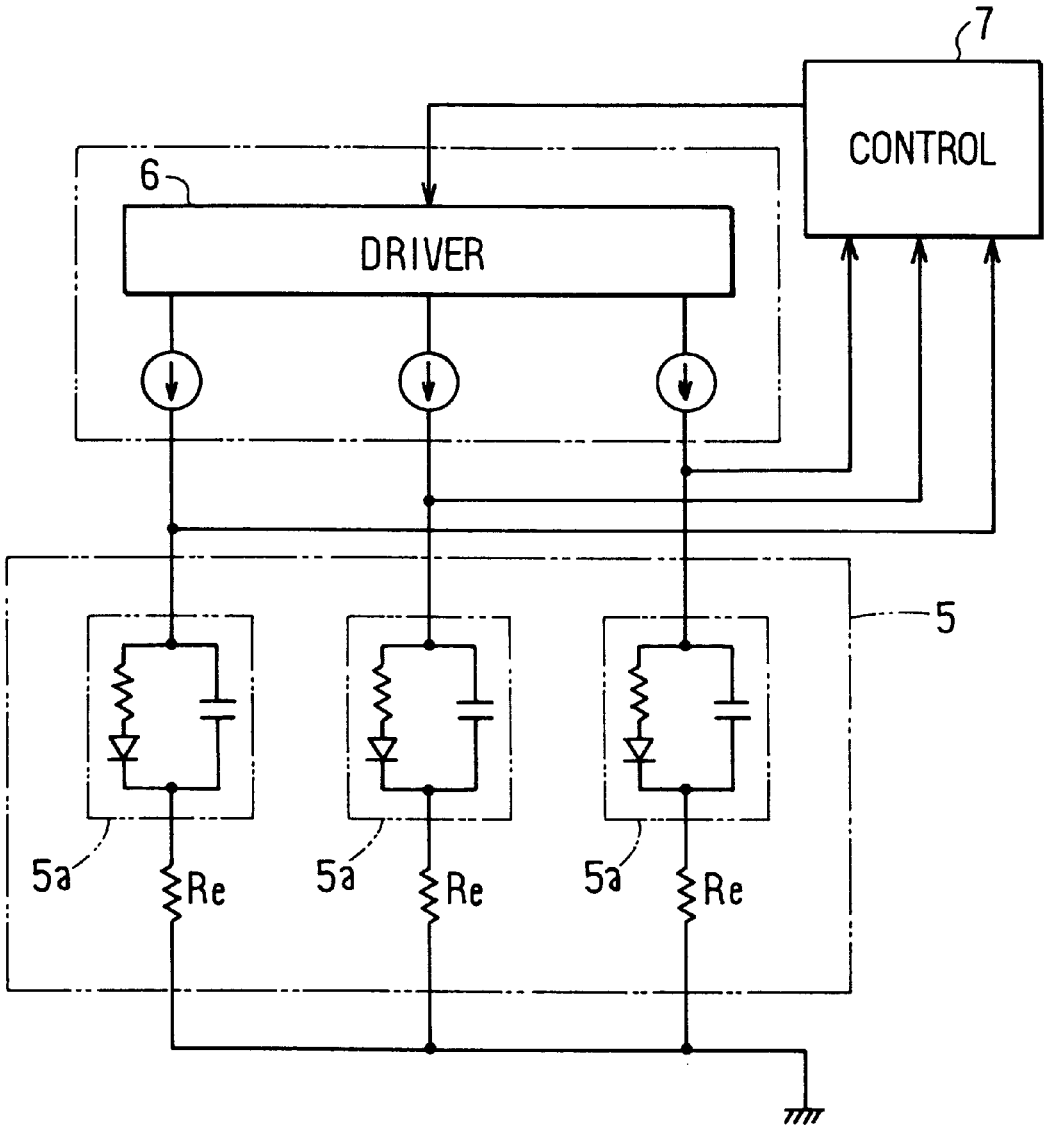
FIG. 11 is an electrical circuit diagram of the organic EL display device according to a fourth embodiment of the present invention.

In a fourth embodiment, as shown in FIG. 11, the control circuit 7 is constructed to monitor a voltage applied to each EL element 5*a* when the same is driven with the constant current and determine the degree of degradation of each EL element 5*a*. The control circuit 7 controls the driving of the EL elements 5*a* based on the determined degree of degradation in the same manner as in the third embodiment.

Figure 12:
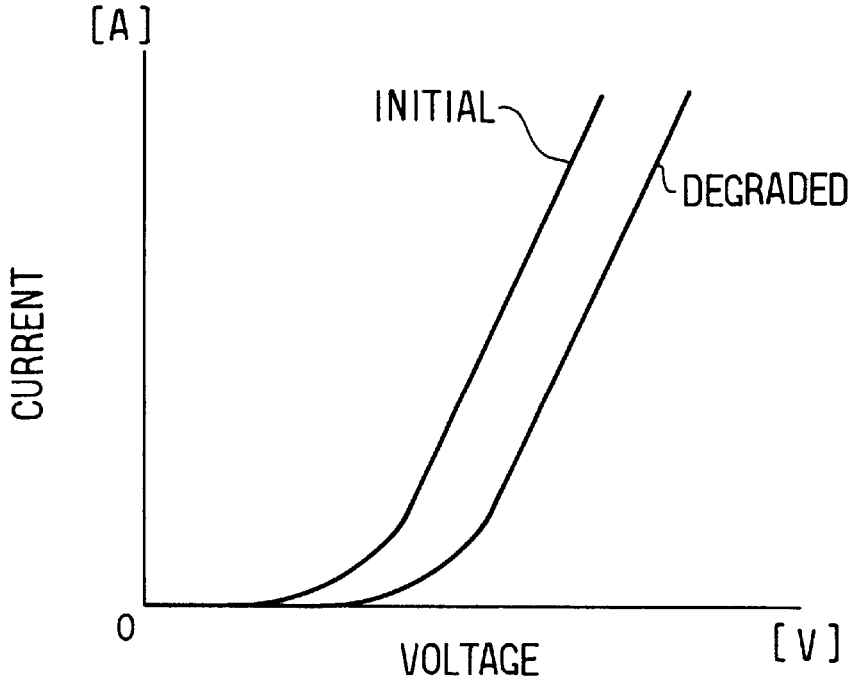
FIG. 12 is a graph of voltage-current characteristics of the EL element in the fourth embodiment.
Figure 13:
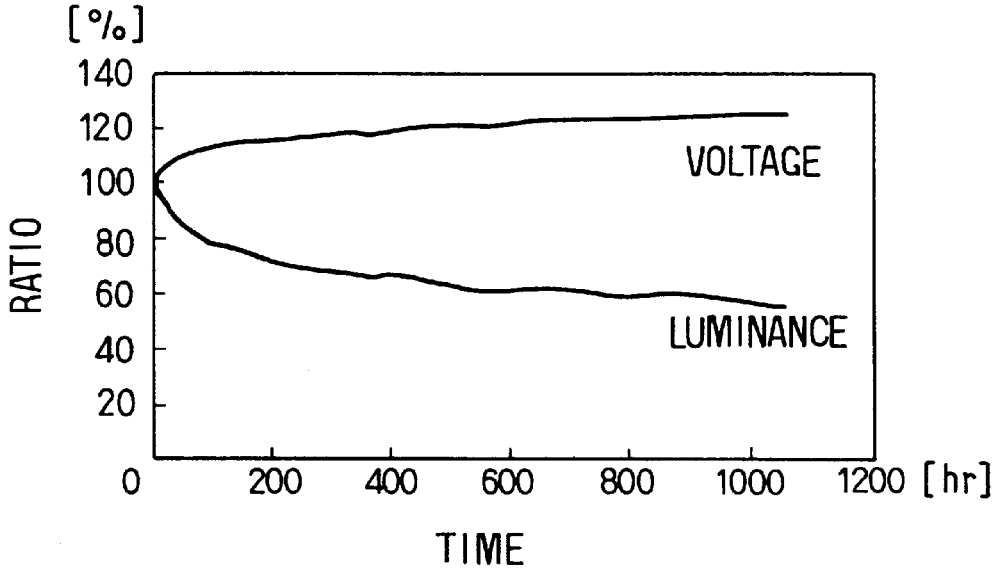
FIG. 13 is a graph of time-voltage ratio and time-luminance characteristics of the EL element in the fourth embodiment.
Figure 14:
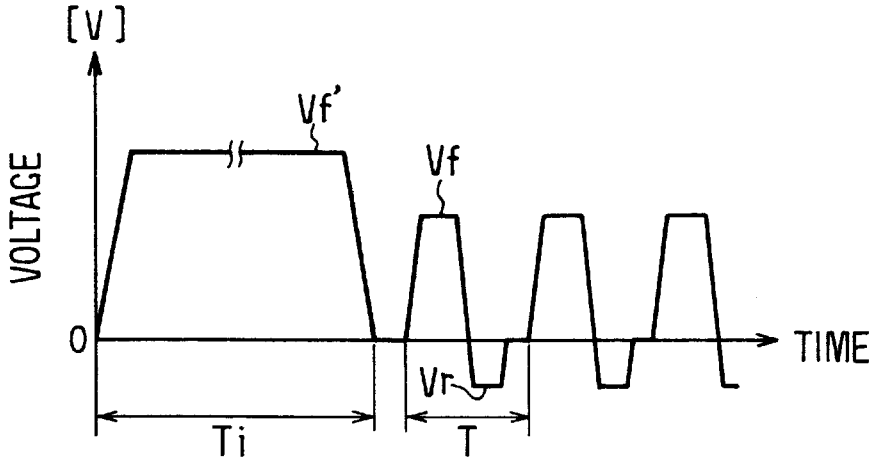
FIG. 14 is a signal diagram of the drive voltage applied to the EL element in a fifth embodiment of the present invention.

The voltage-current characteristics of the EL element 5*a* changes as shown in FIG. 12. Further, as shown in FIG. 13, the EL element 5*a* has a characteristics that the applied voltage increases as the luminance lowers due to degradation, when the EL element 5*a* is driven with the constant current. Thus, the degree of degradation of each EL element 5*a* can be determined based on the monitored voltage without using a timer or counter.

In the fourth embodiment, the EL display panel 5 constructed in the segment-type may also be constructed in the matrix-type as shown in FIG. 2. In this instance, the voltage applied to each EL segment 1*c* should be detected based on the voltages applied to the electrodes 1*a* and 1*b*.

(Fifth Embodiment)

In a fifth embodiment, each EL element 5*a* which is determined to be less degraded is driven with an initial drive voltage Vf' before the drive voltage Vf and the recovery voltage Vr are applied periodically. The initial drive voltage Vf' is set to have an amplitude higher than that of the drive voltage Vr and a period Ti longer than that T of the drive voltage Vf. The initial drive voltage Vf' is applied only when a power supply to apply the drive voltage to the EL elements 5*a* is started, for instance, an ignition switch is turned on in the case that the organic EL display panel 5 is used in a vehicle. This operation may be attained by the similar circuit construction of the third embodiment (FIG. 7). The amplitude of the initial drive voltage Vf' need not be higher than that of the drive voltage Vr.

According to the third embodiment, the initial drive voltage Vf' is effective to promote the degradation in luminance of less-degraded EL elements each time the power supply is started. Thus, the variations in the degradation among the EL elements 5*a* are minimized and, as a result, the time period in which the variations in luminance on the organic EL display panel 5 are maintained at a minimum can be lengthened. It is to be noted that the initial drive voltage Vf' drives the EL elements 5*a* to illuminate. However, this illumination will not affect the normal display operation of the organic EL display device 5, because the initial drive voltage Vf' is limited to only the time period Ti and once at the time of starting the power supply.

(Sixth Embodiment)

In a sixth embodiment, the period of applying the drive voltage Vf is increased as the EL element 5*a* is determined to be more degraded. This operation may be attained by the similar circuit construction of the third embodiment (FIG. 7).

Figure 15:
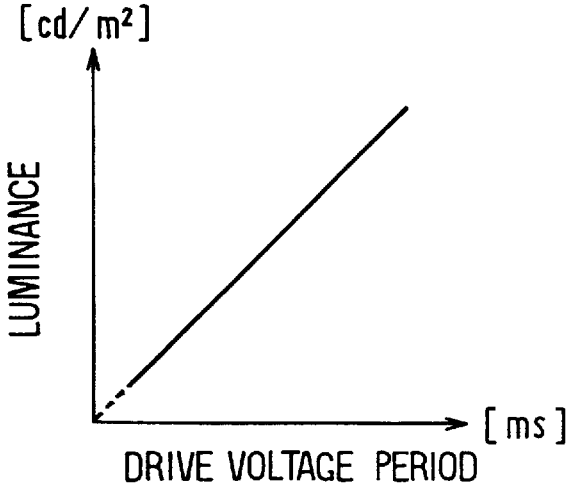
FIG. 15 is a graph of drive voltage-luminance characteristics of the EL element in a sixth embodiment of the present invention.

As shown in FIG. 15, the luminance of each EL element 5*a* increases in proportion to the period of the drive voltage Vf. Therefore, the third embodiment is effective to increase the period of the drive voltage Vf as the luminance of the EL element 5*a* decreases due to degradation in luminance so that the luminance is more equalized among the EL elements 5*a*.

Figure 16:
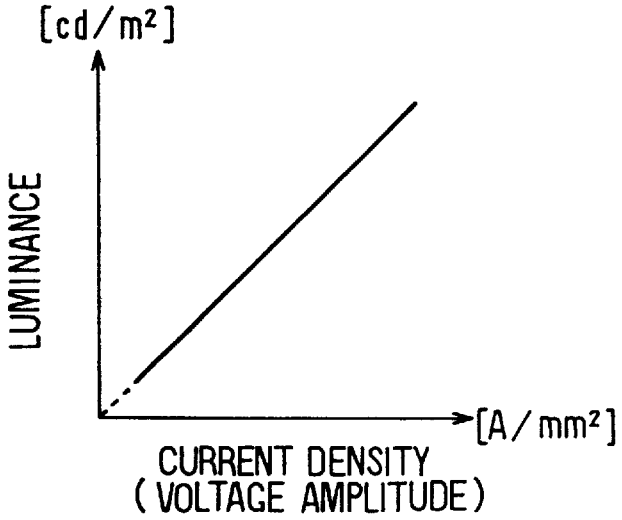
FIG. 16 is a graph of current density-luminance characteristics of the organic EL device in a sixth embodiment of the present invention.

As shown in FIG. 16, the luminance of each EL element 5*a* also increases in proportion to the density of current that is proportional to the amplitude of the drive voltage Vf. Therefore, it is also possible to increase the amplitude of the drive voltage Vf as the EL element 5*a* is determined to be more degraded.

Alternatively, the period or the amplitude of the drive voltage Vf may also be decreased as the EL element 5*a* is determined to be less degraded. As long as the EL element 5*a* is not degraded so much, the decreased drive voltage will be effective to lower the luminance of the EL element 5*a* so that the luminance is more equalized among the EL elements 5*a*.

(Other Embodiments)

In each of the above embodiments, all the EL elements may be driven to illuminate with lower luminance to operate as a screen saver while normal image display is not required. As understood from FIG. 13, for instance, the EL element degrades more slowly as the period or the number of its illumination increases. During the screen saver operation, the degradation proceeds in both the more-degraded EL elements and less-degraded EL elements. However, the degradation proceeds more slowly in the more-degraded EL elements than in the less-degraded EL elements. Thus, driving all the EL elements as the screen saver is effective to minimize variations in the luminance among the EL elements. Although the luminance of all the EL elements decreases due to the screen saver operation, the luminance can be maintained by appropriately regulating the period, amplitude or repetition period of the drive voltage.

In the case that the control circuit 7 is constructed to determine the degree of degradation of the EL element as in the third and fourth embodiments, only the less-degraded EL elements may be driven to operate as the screen saver while the normal display operation is not required. In this instance, only the less-degraded EL elements degrades more so that variations in the degradation among all the EL elements may be more equalized.

In the case that some of the EL elements which will be driven less frequently can be predicted in advance, the initial luminance of such EL elements may be reduced through aging processing. As understood from FIG. 13, the degradation in luminance of the EL element progresses at a higher speed for the first 100 hours. Therefore, reducing the initial luminance of less-frequently driven EL elements will be effective to prolong the length of time in which the difference in degradation between the less-frequently driven EL elements and the more-frequently driven EL elements is maintained small. The difference in luminance among the EL elements becomes noticeable on the organic EL display panel. Therefore, it is preferred to set the initial luminance of the less-frequently driven EL elements to be about 70% of that of the more-frequently driven EL elements.

The present invention should not be limited to the disclosed embodiments, but may be implemented in many other ways without departing from the spirit of the invention.

What is claimed is:

1. A display device comprising:

a display panel having a plurality of organic EL elements; and a circuit for selectively applying drive voltages to the EL element to be driven so that the driven EL element illuminates for a required image display operation on the display panel, wherein the circuit includes dummy voltage means for applying a dummy voltage to the EL element that is not driven for the required image display operation to promote degradation of the non-driven EL elements, the dummy voltage having a waveform different from that of the drive voltage.

2. The display device as in claim 1, wherein the dummy voltage has a period shorter than that of the drive voltage and is applied to the non-driven EL element periodically.

3. The display device as in claim 1, wherein the dummy voltage has an amplitude that are insufficient to drive the non-driven EL element to illuminate normally.

4. A display device comprising:

a display panel having a plurality of organic EL elements; and a circuit for selectively applying drive voltages to the EL element to be driven so that the driven EL, element illuminates for a required image display operation on the display panel, wherein the circuit includes determination means for determining a degree of degradation of each of the EL elements, and wherein the circuit applies only the drive voltage to the driven EL element when a determined degree of degradation of the driven EL element is low, and alternatively applies the drive voltage and an operation characteristics recovery voltage to the driven EL element when the determined degree of degradation of the driven EL element is high.

5. A display device comprising:

a display panel having a plurality of organic EL elements; and a circuit for selectively applying drive voltages to the EL element to be driven so that the driven EL element illuminates for a required image display operation on the display panel, wherein the circuit includes determination means for determining a degree of degradation of each of the EL elements, and wherein the circuit selectively applies the drive voltage and an operation characteristics recovery voltage to the driven EL element based on a determined degree of degradation of the driven EL element, and reduces one of a period of application and amplitude of the operation characteristics recovery voltage as the determined degree of degradation of the driven EL element decreases.

6. The display device as in claim 4 or 5, wherein the operation characteristics recovery voltage is opposite in polarity to the drive voltage.

7. A display device comprising:

a display panel having a plurality of organic EL elements; and a circuit for selectively applying drive voltages to an EL element to be driven so that the driven EL element illuminates for a required image display operation on the display panel, wherein the circuit includes determination means for determining a degree of degradation of each of the EL elements, and wherein the circuit applies an initial drive voltage to an EL element determined to be less degraded only for a predetermined period each time a power supply to the display panel is started.

8. A display device comprising:

a display panel having a plurality of organic EL elements; and a circuit for selectively applying drive voltages to the EL element to be driven so that the EL element illuminates for a required image display operation on the display panel, wherein the circuit includes determination means for determining a degree of degradation of each of the EL elements, and wherein the circuit drives all the EL elements for a screen saver operation while the required image display operation is not effected, luminance of the EL elements in the screen saver operation being limited to be lower than that in the required image display operation.

9. A display device comprising:

a display panel having a plurality of organic EL elements; and a circuit for selectively applying drive voltages to the EL element to be driven so that the EL element illuminates for a required image display operation on the display panel, wherein the circuit includes determination means for determining a degree of degradation of each of the EL elements, and wherein the circuit drives only the EL elements that are determined to be less-degraded for a screen saver operation while the required image display operation is not effected.

10. A display device comprising:

a display panel having a plurality of organic EL elements; and a circuit for selectively applying drive voltages to the EL element to be driven so that the driven EL element illuminates for a required image display operation on the display panel, wherein the EL elements that are expected to be less frequently driven than the other EL elements are subjected to an aging process by application of a dummy voltage thereto to have an initial luminance lower than that of the other EL elements.

11. The display device as in claim 10, wherein the initial luminance of the less-frequently driven EL elements is set to be about 70% of that of the other EL elements.

12. A display device comprising:

a display panel having a plurality of organic EL elements; and a circuit for selectively applying drive voltages to the EL element to be driven so that the EL element illuminates for a required image display operation on the display panel, wherein the circuit includes determination means for determining a degree of degradation of each of the EL elements, and wherein the circuit gradually increases one of a period of application and an amplitude of the drive voltage applied to the EL element as its determined degree of degradation increases.

13. A display device comprising:

a display panel having a plurality of organic EL elements; and a circuit for selectively applying drive voltages to the EL element to be driven so that the EL element illuminates for a required image display operation on the display panel, wherein the circuit includes determination means for determining a degree of degradation of each of the EL elements, and wherein the circuit relatively decreases one of a period of application and an amplitude of the drive voltage applied to the EL element as its determined degree of degradation decreases.

14. The display apparatus as in any one of claims 4, 5, 7, 9, 12 and 13, wherein the determination means measures an accumulated illumination period of each of the EL elements and determines the degree of degradation based on the measured accumulated illumination period.

15. The display apparatus as in any one of claims 4, 5, 7, 9, 12 and 13, wherein the circuit includes constant current drive means for supplying the EL element to be driven with a constant current, and the determination means monitors a voltage applied to each of the EL elements when driven with the constant current and determines the degree of degradation based on the monitored applied voltage.

* * * * *